United States Patent [19]

Butterworth

[11] 4,415,317

[45] Nov. 15, 1983

[54] WRAP ELEMENT AND TIP SEAL FOR USE IN FLUID APPARATUS OF THE SCROLL TYPE

[75] Inventor: Arthur L. Butterworth, La Crosse, Wis.

[73] Assignee: The Trane Company, La Crosse, Wis.

[21] Appl. No.: 232,526

[22] Filed: Feb. 9, 1981

[51] Int. Cl.[3] ..... F01C 1/02; F01C 19/08; F16J 15/34

[52] U.S. Cl. ..... 418/55; 418/142; 277/96.1; 277/204

[58] Field of Search ..... 418/55, 142; 277/93 SD, 277/96.1, 204, 233

[56] References Cited

U.S. PATENT DOCUMENTS

| | | | |
|---|---|---|---|
| 2,583,957 | 1/1952 | Marvin | 277/233 |
| 2,846,280 | 8/1958 | Berg | 277/233 |
| 3,861,838 | 1/1975 | Lamm | 418/142 |
| 3,994,636 | 11/1976 | McCullough et al. | 418/55 |
| 4,080,120 | 3/1978 | Eiermann | 418/142 |
| 4,199,308 | 4/1980 | McCullough | 418/55 |

FOREIGN PATENT DOCUMENTS

| | | | |
|---|---|---|---|
| 2432709 | 7/1975 | Fed. Rep. of Germany | 418/142 |
| 240753 | 10/1925 | United Kingdom | 277/233 |
| 995248 | 6/1965 | United Kingdom . | |

*Primary Examiner*—John J. Vrablik
*Attorney, Agent, or Firm*—Carl M. Lewis; Peter D. Ferguson; Ronald M. Anderson

[57] ABSTRACT

A wrap element and tip seal are disclosed for use in fluid apparatus of the scroll type which include a wrap element having a groove disposed within its tip surface of spiroidal configuration generally conforming to that of the wrap element. A tip seal is disposed within the groove and comprises a plurality of strips of material disposed at least partially within the groove and arranged in side-by-side relationship at least partially across the width of the groove, each said strip extending along a longitudinal axis about the spiroidal configuration of the groove. By fabricating the seal from a plurality of strips of material, the necessity for expensive machining operations is obviated while a seal is provided which is relatively flexible in a radial direction as to accommodate the precise groove shape, while remaining relatively inflexible in an axial direction so as to provide the desired sealing characteristics. A variety of back-up means are disclosed for imposing a force upon the plurality of strips in an axial direction away from the wrap element while permitting movement thereof in an axial direction, thereby providing a desired sealing force while also affording a certain amount of axial compliance within the fluid apparatus.

39 Claims, 16 Drawing Figures

WRAP ELEMENT AND TIP SEAL FOR USE IN FLUID APPARATUS OF THE SCROLL TYPE

DESCRIPTION

TECHNICAL FIELD

The present invention relates generally to the field of fluid apparatus of the scroll type, including compressors, pumps, and expanders; and is specifically directed to an improvement in such apparatus relating to the tip seal provided therein which effects sealing between the axial tip portion of a wrap element and a cooperating end plate.

BACKGROUND ART

In the field of positive displacement fluid apparatus, there exists a class or category generally referred to as scroll-type fluid apparatus which are characterized by the provision of wrap elements defining flank surfaces of generally spiroidal configuration about respective axes, which wrap elements lie in intermeshing, angularly offset relationship with their axes generally parallel such that relative orbital motion between the wrap elements results in the formation of one or more moving volumes between the wrap elements, defined by moving lines of coaction between the wrap elements at which their flank surfaces lie substantially tangent to each other. In a preferred form, the precise shape of the generally spiroidal flank surfaces comprise an involute of a circle, however, the term "generally spiroidal" is intended to encompass any form providing the requisite moving volumes during relative orbital motion between the wrap elements. Typically, end plate means are provided in sealing relationship to the wrap elements as they undergo relative orbital motion such that the moving volumes are effectively sealed. Reference may be had to U.S. Pat. No. 801,182 for an early disclosure of scroll-type fluid apparatus embodying this principle, or to U.S. Pat. No. 3,884,599 for a more recent disclosure.

It has been recognized that scroll-type fluid apparatus have utility in a wide variety of applications, including gas compressors or vacuum pumps for elevating the pressure of a gaseous working fluid; liquid pumps for transporting a liquid working fluid; or as an expansion engine for producing mechanical work by the expansion of a relatively high pressure gaseous working fluid. In the case of a gas compressor, the moving volumes defined between wrap elements originate at a radially outer portion thereof and progress inwardly while their volume is reduced, resulting in compression of the working gas which is then discharged at a radially inner portion of the wrap elements. Liquid pumps function in a similar fashion with the wrap elements configured such that no appreciable reduction in volume occurs at the volumes progress radially inwardly, while scroll-type expansion engines receive a relatively high pressure gaseous working fluid at the radially inner portion of their wrap elements, which then progresses radially outwardly in the moving volumes as they increase in volume, resulting in expansion of the working fluid and production of mechanical work.

In considering the kinematic relationship necessary in order to effect the requisite relative orbital motion between the wrap elements, it should be noted that at least three general approaches exist:

(1) maintaining one wrap element fixed while orbiting the other with respect thereto, i.e., causing it to undergo circular translation while maintaining a fixed angular relationship between the wrap elements;

(2) orbiting both wrap elements in opposite directions while maintaining a fixed angular relationship therebetween; and (3) rotating both wrap elements about offset, parallel axes while maintaining a fixed angular relationship therebetween.

A second consideration relevant to the relative orbital motion between wrap elements is the manner in which their flank surfaces are permitted to coact with each other; i.e., is actual contact permitted therebetween along the lines at which the surfaces lie substantially tangent, accompanied by a radial sealing force therebetween; or are constraints imposed thereon so as to maintain a slight clearance or gap therebetween. In this regard, it is convenient to term the former as "radially compliant" type, while the latter may be referred to as "fixed-crank" type. As used herein, the term "moving line coaction" is intended to be descriptive of both types, while the term "actual moving line contact" is limited to the radially compliant type. Reference may be had to U.S. Pat. No. 3,924,977 for disclosure of a radially compliant type drive mechanism, while U.S. Pat. No. 4,082,484 is illustrative of the fixed-crank type.

Reference may be had to the aforementioned U.S. Pat. No. 801,182 for an early disclosure of a tip seal for use in scroll apparatus, while U.S. Pat. No. 3,994,636 is illustrative of a more recent development in this area. In both these references, however, it is apparent that the seal element itself is constructed from a single strip of material, the '636 patent suggesting both metallic or nonmetallic materials including cast iron, steel, bronze, carbon, or plastics such as polytetrafluoroethylene, or polyamides. As will be appreciated, the use of a single strip of material in order to form the seal element has the drawback that it must be machined or otherwise formed to the precise involute shape of the groove in the wrap element in order to afford proper operation. This requirement is a distinct drawback in the case of preferred metallic sealing elements which require expensive machining operations in order to provide a proper seal, as well as with many plastics materials which are not sufficiently elastic to be formed into the desired shape, which would also require machining or some sort of molding operation in order to be formed.

Reference may also be had to U.S. Pat. No. 4,199,308 for a further disclosure of a tip seal for scroll-type fluid apparatus, wherein the novelty lies in the particular configuration of the groove formed in the wrap element and its cooperating seal element.

DISCLOSURE OF THE INVENTION

In accordance with the present invention, a wrap element and tip seal for use in fluid apparatus of the scroll type are provided comprising a wrap element defining at least a first, and preferably first and second, flank surfaces of generally spiroidal configuration about an axis, the flank surfaces extending generally in an axial direction and terminating in a tip surface lying in a plane substantially perpendicular to the axis. A groove disposed within the tip surface has a spiroidal configuration generally conforming to that of the flank surfaces, the groove having a width measured in a generally radial direction in respect to the axis and a depth measured in an axial direction from the tip surface. A tip seal comprises a plurality of strips of material disposed at least partially within the groove and arranged in side-by-side relationship at least partially across its width, each strip extending along a longitudinal axis about the spiroidal configuration of the groove and having a width measured in a generally radial direction with respect to the axis and a height measured in an axial direction. In a first embodiment the groove includes both radially inner and outer lateral walls and a bottom wall, while in a second embodiment, the groove includes only a radially outer wall and a bottom wall.

Preferably, the height of each strip of material making up the tip seal is substantially greater than its width and each strip defines oppositely facing, substantially parallel lateral surfaces as well as an axial tip surface which is slightly rounded. The adjacent lateral surfaces of adjacent strips are in substantially parallel, contiguous relationship and may be affixed to one another at their radially inner end portions, at both their radially inner and outer end portions, or at a plurality of spaced-apart locations along their longitudinal axes. In the case wherein the strips of material are metallic such as steel, they may be conveniently affixed to one another by spot welding.

The strips of material making up the tip seal are relatively flexible about an axis extending generally parallel to their height, and relatively inflexible about an axis extending generally parallel to their width, thereby providing a seal element which is flexible in a generally radial direction so as to effect sealing with a lateral wall of the groove, while remaining relatively inflexible in an axial direction so as to provide a relatively rigid seal for coaction with a cooperating end plate in the fluid apparatus. It is further possible that the strips may be biased in such a manner as to be urged toward a radially outer lateral wall of the groove.

If desired, a secondary strip of material may be disposed at least partially within the groove at a location between the tip seal and a lateral wall of the groove, which secondary strip may be constructed of a resilient material such as "Teflon" or other plastics material so as to effect a seal with the lateral wall. Preferably, the secondary strip is disposed between a radially outer lateral wall of the groove and the tip seal so as to be urged into sealing engagement therewith by the pressure differentials within the fluid apparatus during operation.

In a further embodiment, a carrier may be provided for the strips of material comprising an elongated member disposed within the groove and having a generally U-shaped cross section, the plurality of strips being carried within the interior of the U. Conveniently, the carrier may be constructed of a resilient material so as to effect a seal with the lateral wall or walls of the groove as discussed previously.

In all embodiments of the invention, it may be desirable to provide back-up means for imposing a force upon the tip seal in an axial direction away from the wrap element, while permitting movement thereof in an axial direction. Such back-up means may be disposed between a bottom wall of the groove and the tip seal and may comprise a plurality of helical coil springs, helical springs of the volute type, a length of resilient cord stock, or a generally flat, elongated spring member and operating generally according to the principle of a Belleville spring or washer.

Accordingly, it is an object of the present invention to provide a wrap element and tip seal for use in fluid apparatus of the scroll type wherein the tip seal is conveniently fabricated from a plurality of strips of material disposed within the groove of a wrap element and arranged in side-by-side relationship at least partially across its width, which tip seal may be fabricated without expensive machining or casting operations.

A further object of the invention lies in the provision of a tip seal which remains relatively flexible in a generally radial direction within the groove while remaining relatively inflexible in an axial direction so as to provide a rigid sealing surface for cooperation with an end plate.

Related to the last-mentioned object is the provision of a tip seal wherein its relative flexibility in the radial direction permits the formation of an effective secondary seal between it and a radially outer lateral wall of the groove.

Yet another object of the invention lies in the provision of a tip seal which is relatively low cost to manufacture, yet which provides a sealing function as good as or better than tip seals which are machined through a relatively expensive manufacturing process.

These and further objects of the invention will become apparent from a consideration of the detailed description of the invention which follows and by reference to the accompanying drawings.

BEST MODE FOR CARRYING OUT THE INVENTION

Figure 1:
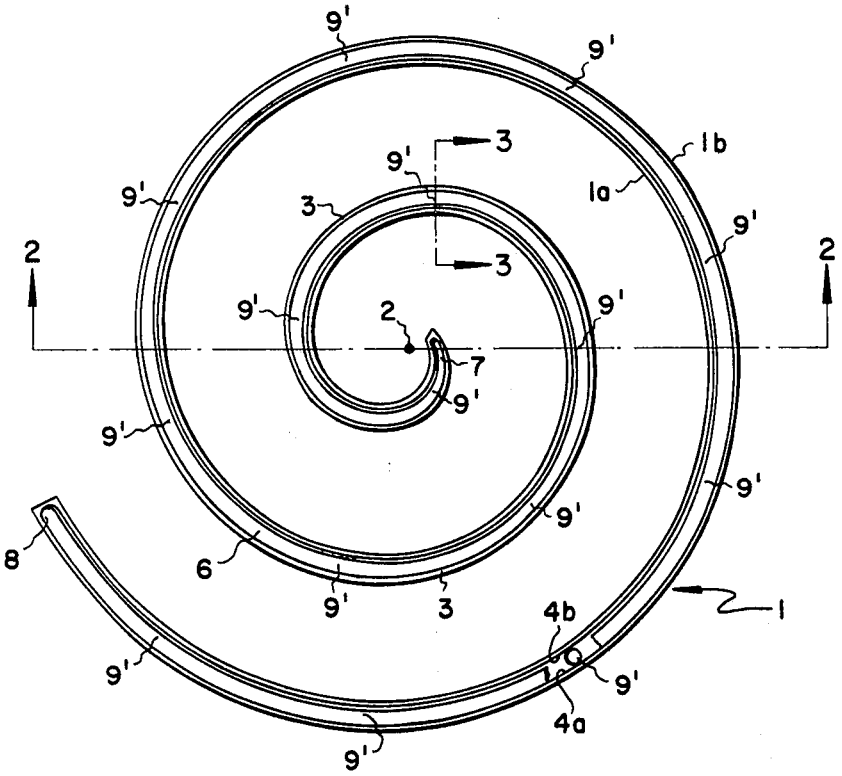
FIG. 1 is a plan view of a wrap element for use in fluid apparatus of the scroll type, including a tip seal constructed in accordance with the present invention.

Turning first to FIG. 1 of the drawings, a wrap element for use in fluid apparatus of the scroll type is illustrated in plan view, designated generally by reference numeral 1. Wrap element 1 includes a first, radially inner flank surface 1*a* and a second, radially outer flank surface 1*b* which, as is apparent from FIG. 1, are of generally spiroidal configuration about an axis 2. From FIG. 2, it can be seen that the flank surfaces 1*a* and 1*b* extend in an axial direction and terminate in a tip surface 3 lying in a plane substantially perpendicular to axis 2.

Disposed within tip surface 3 is a groove having a radially outer lateral wall 4*a*, a radially inner lateral wall 4*b*, and a bottom wall 4*c*. As is apparent from FIG. 1, the groove is of spiroidal configuration generally conforming to that of flank surfaces 1*a* and 1*b*, and has a width measured in a generally radial direction with respect to axis 2 and a depth measured in an axial direction from tip surface 3. Disposed within groove 4 is a tip seal denoted by reference numeral 6 and illustrated only generally in FIGS. 1 and 2 for the sake of clarity, more detailed illustrations thereof appearing in FIGS. 3(*a*) through 3(*n*).

Figure 2:
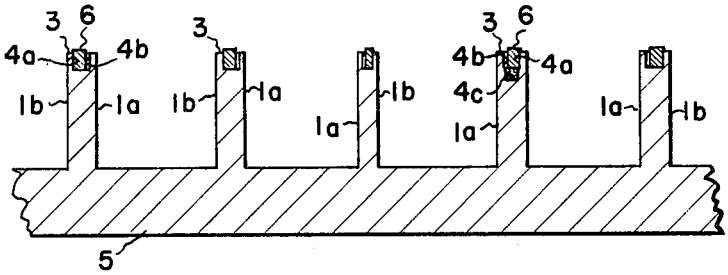
FIG. 2 is a cross section view taken along the line 2—2 of FIG. 1.

Before proceeding to a detailed discussion of the novel tip seal comprising the present invention, it should be pointed out that wrap elements of the type illustrated in FIGS. 1 and 2 are well known to those skilled in the art of fluid apparatus of the scroll type as discussed previously in the subject application. As further illustrated in FIG. 2, the wrap element may be affixed to an end plate 5 such that fluid apparatus of the scroll type may be constructed utilizing two, substantially identical scroll members arranged in intermeshing, angularly offset relationship as described in many of the references alluded to previously.

Figure 3:
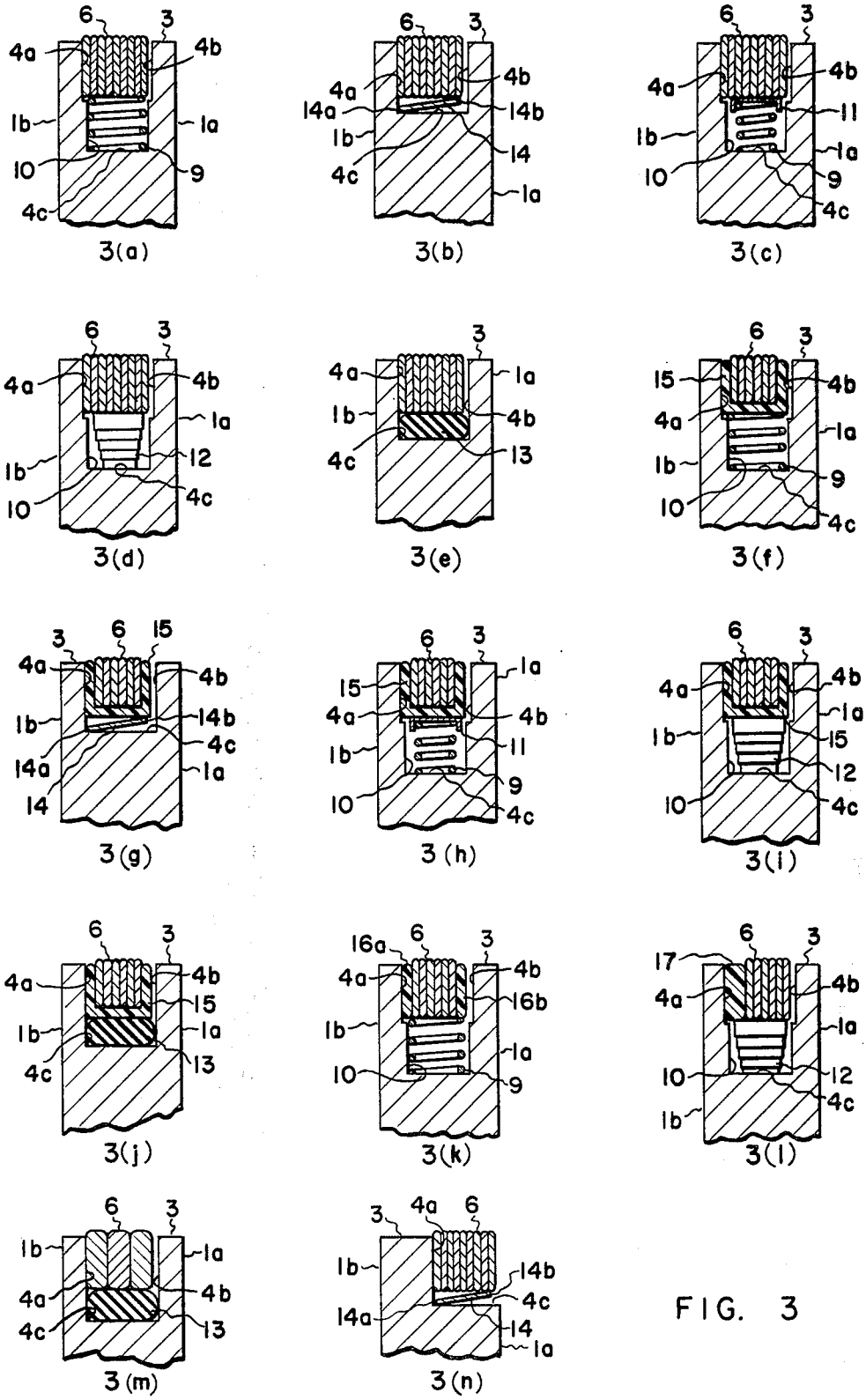
FIGS. 3(*a*) through 3(*n*) are cross section views taken along the line 3—3 of FIG. 1, illustrating a variety of configurations which the tip seal and back-up means may take in accordance with the present invention.

Turning next to FIG. 3(*a*) of the drawings, an enlarged cross section of the upper portion of wrap element 1 is shown in order to afford a detailed illustration of the tip seal comprising the present invention. As there shown, a plurality of strips of material, each to be referred to by a reference numeral 6, are disposed at least partially within groove 4 and are arranged in side-by-side relationship at least partially across its width, each strip extending along a longitudinal axis about the spiroidal configuration of the groove and having a width measured in a generally radial direction with respect to axis 2 and a height measured in an axial direction. As is apparent from FIG. 3(*a*), the height of each strip of material 6 is substantially greater than its width, and each strip defines oppositely facing, substantially parallel lateral surfaces as well as an axial tip surface which, as shown, may be slightly rounded either intentionally or due to the manner in which the strips 6 are formed. From FIG. 3(*a*) it may also be seen that the adjacent lateral surfaces of adjacent strips 6 are in substantially parallel, contiguous relationship so as to define a composite seal element disposed within the groove. Due to the slightly rounded configuration of the axial tip surface of each strip 6, the axial sealing surface of the composite seal element has a labyrinth effect which may enhance the sealing properties thereof, especially when lubricating oil is present within the apparatus and entrained by the seal element.

It will be appreciated that, due to the cross-sectional configuration of each strip of material 6 having a height substantially greater than its width, each such strip is relatively flexible about an axis extending generally parallel to its height; or in a radial direction with respect to axis 2; while remaining relatively inflexible about an axis extending generally parallel to its width, or in an axial direction. Moreover, these flexibility characteristics are maintained in the composite seal element but may be varied depending upon the number of locations at which strips of material 6 are affixed to one another, as will be discussed in greater detail below.

It should thus be appreciated that the composite seal element formed from the plurality of strips of material 6 has the advantage of being easily formed into a spiroidal configuration due to flexibility in the radial direction, while simultaneously remaining relatively rigid in an axial direction so as to define a composite sealing surface generally parallel to tip surface 3 for coaction with the generally planar end plate of a mating scroll member when assembled in a compressor or other fluid apparatus. Radial flexibility is an advantage in seal elements of this type not only from the standpoint of being relatively low cost to fabricate, not requiring any expensive machining operations, but also providing an operating advantage during operation of the fluid apparatus. To illustrate the latter, consider the composite seal element of FIG. 3(*a*) during operation in fluid apparatus such as a compressor when a relatively high fluid pressure exists adjacent radially inner flank surface 1*a*, while a relatively low fluid pressure exists adjacent radially outer flank surface 1*b*. This pressure differential acts to urge the composite seal element in a radially outer direction, as generally shown in FIG. 3(*a*), so as to effect a secondary seal between radially outer lateral wall 4*a* of the groove and the radially outer lateral surface of the left-most (as viewed in FIG. 3[*a*]) strip of material 6 defining the composite seal element. Due to the radial flexibility exhibited by the composite seal element, a positive secondary seal is enhanced. Moreover, in order to enhance or augment this secondary seal, the composite seal element may be biased in such a manner as to be urged in a radially outward direction due to the spring characteristics of the composite seal element.

In order to simplify fabrication of the composite seal element as well as assembly thereof into wrap element 1, it has been found convenient to affix the strips of material 6 to one another at least at their radially inner end portions 7, as shown in FIG. 1, but the strips 6 may also be affixed to one another at both radially inner portion 7 and radially outer portion 8 if desired. Alternatively, strips of material 6 may be affixed to one another at a plurality of spaced locations along their longitudinal axes, including their radially inner portion 7 and radially outer portion 8. In the case where strips of material 6 are formed of a metal such as steel, they may be conveniently affixed to one another using spot welding.

It has been found convenient to construct strips 6 from steel due to its relative low cost, ease of fabrication, and excellent wearing properties, in which case it is believed that strips 6 may have a width from about 0.007 inches to about 0.025 inches, with lesser widths being susceptible to their axial tip portions bending over, while thicker widths would not exhibit the required degree of flexibility.

As further illustrated in FIG. 3(*a*), back-up means are provided for imposing a force upon strips of material 6 in an axial direction away from wrap element 1, while permitting movement of the strips of material in an axial direction, which back-up means comprise in the case of FIG. 3(*a*) a plurality of helical coil springs 9 formed from wire having a substantially circular cross section. Springs 9 are disposed within axial bores 10 drilled in bottom wall 4*c* of the groove. Springs 9 are located at a plurality of longitudinally spaced points along the groove, which points are indicated by reference numerals 9' of FIG. 1. As will be appreciated by those skilled in the art of scroll-type fluid apparatus, the back-up means not only serve to provide a sealing force between the axial tip surface of the composite seal element and a cooperating end plate of a mating scroll member, but also serve to provide a degree of axial compliance between the mating scroll members.

Turning next to the embodiment illustrated in FIG. 3(*c*) of the drawings, it will be noted that this embodiment is substantially identical to that of FIG. 3(*a*), with the exception that a cap member 11 is provided between the upper portion of spring 9 and the plurality of strips of material 6, cap member 11 serving to evenly distribute the axial force imposed by spring 9 over all of the strips of material 6.

FIG. 3(*d*) of the drawings illustrates yet a further embodiment substantially identical to that of FIG. 3(*a*), this time with the exception that in lieu of helical coil springs 9 formed from wire having a substantially circular cross section, helical springs 12 of the volute type are provided which are formed from substantially flat spring stock. Although not illustrated in the drawings, volute-type springs 12 may also be provided with a cap member similar to that shown at 11 in FIG. 3(*c*).

The embodiment of the invention illustrated in FIG. 3(*e*) utilizes back-up means which comprise a length of resilient cord stock 13 disposed within the groove between its bottom wall 4c and the underside of the composite seal element. This type back-up means is disclosed in previously referenced U.S. Pat. No. 3,994,636 and, as discussed therein, has the advantage of providing a positive secondary seal in order to prevent leakage underneath the composite seal element.

Turning now to FIG. 3(*b*) of the drawings, another type of back-up means is disclosed which comprises a generally flat, elongated spring member 14 which is disposed between bottom wall 4c of groove 4 and the underside of strips of material 6 forming the composite seal element. Spring member 14 extends along a longitudinal axis about the spiroidal configuration of groove 4 and has a position therein such that its radially outer edge portion 14a engages the bottom wall of the groove while its radially inner edge portion 14b is axially spaced therefrom. With this configuration, spring member 14 acts according to the principle of a Belleville spring or washer such that an axial force is developed as edge portion 14b is displaced towards bottom wall 4c of the groove, thereby providing the axial force previously discussed. Reference may be had to copending, commonly assigned application Ser. No. 6,232,528, filed Feb. 9, 1981, for a complete disclosure of this type back-up member, which disclosure is hereby incorporated herein.

Turning next to FIGS. 3(*f*) through 3(*i*) of the drawings, it will be noted that these embodiments correspond generally to those of FIGS. 3(*a*) through 3(*e*), respectively, insofar as the particular back-up means provided are concerned; accordingly, no detailed discussion of that aspect of these embodiments is believed warranted. The embodiments of FIGS. 3(*f*) through 3(*i*) differ over those previously discussed, however, in that a carrier 15 is provided for strips of material 6 and comprises an elongated member disposed within the groove and having a generally U-shaped cross section, the bight portion thereof lying along bottom wall 4c of the groove and the arm portions extending axially therefrom along lateral walls 4a and 4b, respectively, of the groove. Strips of material 6 are disposed within the U-shaped carrier 15 as shown, an arrangement which would facilitate fabrication, handling, and assembly of the tip seal into wrap element 1. Preferably, carrier 15 would be constructed of a resilient material such as plastics or the like so as to effect a positive seal at least with radially outer lateral wall 4a of the groove.

The embodiment illustrated in FIG. 3(*k*) of the drawings, while using helical coil springs similar to those of FIG. 3(*a*) as the back-up means, further includes first and second secondary strips 16a and 16b which are constructed of a resilient material so as to effect a seal at least with radially outer lateral wall 4a, and possibly also with radially inner lateral wall 4b, depending upon the precision with which the seal element and groove are fabricated. It should be further noted that strips 16a and 16b serve the purpose of preventing strips of material 6 from sliding in a radial direction off of springs 9.

The embodiment illustrated in FIGS. 3(*l*), while utilizing coil springs of the volute type as shown in FIG. 3(*d*) as the back-up means, differs in that a single secondary strip 17 is provided between radially outer lateral wall 4a of the groove and the composite seal element comprising strips of material 6. As discussed previously, due to the pressure conditions existing across wrap element 1 during operation of the scroll apparatus, this radially outer secondary seal is of considerable importance and the provision of a secondary strip 17 constructed of a resilient material may be desirable in order to enhance this seal.

The embodiment of FIG. 3(*m*) is included, utilizing back-up means 13 as discussed with respect to FIG. 3(*e*), but wherein the composite seal element includes only three strips of material. This Figure is included to illustrate the point that, depending upon the particular material used in fabricating strips 6, the thickness may be increased or decreased in order to afford the desired degree of flexibility in the seal element, as well as to take advantage of the particular elastic properties of a given material.

Finally, the embodiment of FIG. 3(*n*) is included in order to illustrate a tip seal constructed in accordance with the present invention in connection with a wrap element having an "open-face" groove similar to that disclosed in U.S. Pat. No. 4,199,308. In this embodiment, the groove includes only a radially outer lateral wall 4a and a bottom wall 4c, a configuration which may be easier to machine in certain circumstances than the groove shown in the previous embodiments.

It should now be appreciated that the tip seal according to the present invention may be relatively easily and inexpensively fabricated from materials possessing the requisite elasticity in the sizes required for a particular fluid apparatus, such materials including metals such as hardened or spring steels, and also including suitable plastics materials having a requisite durability for this type application. The composite seal may be fabricated simply by cutting the desired number of strips of material to a desired length and inserting them within the groove provided in the wrap element, although, as discussed previously, it is preferred that the strips of material 6 be affixed to one another at least at their radially inner end portion, and preferably at a plurality of locations along their longitudinal axes. As will be appreciated, the more points at which the strips are affixed to one another, the less flexible will be the resulting composite seal element in the radial direction. It has further been found that the composite seal element may be formed by initially affixing the strips of material at a first end portion thereof, then wrapping the strips into the desired involute configuration, and affixing the other end portions thereof to one another; an operation which may or may not be followed by the provision of additional points along their longitudinal axes at which they are affixed to one another. As previously discussed, the composite seal element may be provided with a pre-load or bias in a radially outward direction as to enhance or augment the secondary seal alluded to in the foregoing discussion.

It should also be pointed out that although the embodiments illustrated each include some form of back-up means, it is possible that the composite seal element disclosed could be utilized without a back-up means, relying instead upon the pressure differentials existing within the apparatus to bias the seal element; as discussed generally in U.S. Pat. No. 3,994,636 with respect to FIG. 3 thereof.

Moreover, although the strips of material 6 in the disclosed embodiments each are continous along the length of the spiroidal groove, it is possible that a composite seal element might be fabricated using a series of shorter length strips suitably affixed to one another, which modification would lie within the scope of the present invention.

While the invention has been described with respect to a number of specific embodiments, it is to be understood that variations thereto will become apparent to those skilled in the art upon a consideration thereof, particularly as regards the type of back-up means provided, the precise number of strips utilized to make up the composite seal element, as well as the particular materials and thicknesses thereof utilized in fabricating the seal. Accordingly, the scope of the invention is to be determined in accordance with the scope and spirit of the claims which follow.

I claim:

1. A tip seal for use in fluid apparatus of the scroll type comprising a plurality of strips of material arranged in side-by-side relationship and extending along longitudinal axes in generally spiroidal configuration about an axis, each said strip having a width measured in a generally radial direction with respect to said axis and a height measured in an axial direction, said strips being relatively flexible about an axis extending generally parallel to their height, and relatively inflexible about an axis extending generally parallel to their width.

2. The tip seal of claim 1 wherein the height of each strip of material is substantially greater than its width.

3. The tip seal of claim 1 wherein each strip defines oppositely facing, substantially parallel lateral surfaces; and an axial tip surface.

4. The tip seal of claim 3 wherein the axial tip surface of each strip is slightly rounded.

5. The tip seal of claim 3 wherein the adjacent lateral surfaces of adjacent strips are in substantially parallel, contiguous relationship.

6. The tip seal of claim 1 wherein said strips are affixed to one another at least at their radially inner end portions.

7. The tip seal of claim 6 wherein said strips are affixed to one another at their radially inner and outer end portions.

8. The tip seal of claim 1 wherein said strips are affixed to one another at a plurality of spaced-apart locations along their longitudinal axes.

9. The tip seal of claims 6, 7, or 8 wherein said strips of material are metallic, and wherein they are affixed to one another as aforesaid by spot welding.

10. The tip seal of claim 1 wherein said plurality of strips of material comprise from three to nine strips.

11. The tip seal of claim 1 wherein said strips of material are constructed of steel and have a width from about 0.007 inches to about 0.025 inches.

12. A wrap element and tip seal for use in fluid apparatus of the scroll type comprising a. a wrap element defining at least a first flank surface of generally spiroidal configuration about an axis, said flank surface extending generally in an axial direction and terminating in a tip surface lying in a plane substantially perpendicular to said axis;

b. a groove disposed within said tip surface of spiroidal configuration generally conforming to that of said flank surface, said groove having a width measured in a generally radial direction with respect to said axis and a depth measured in an axial direction from said tip surface; and c. a tip seal comprising a plurality of strips of material disposed at least partially within said groove and arranged in side-by-side relationship at least partially across its width, each said strip extending along a longitudinal axis about the spiroidal configuration of said groove and having a width measured in a generally radial direction with respect to said axis and a height measured in an axial direction, said strips being relatively flexible about an axis extending generally parallel to their height, and relatively inflexible about an axis extending generally parallel to their width.

13. The wrap element and tip seal of claim 12 wherein said wrap element defines first and second flank surfaces of generally spiroidal configuration, each of which extends in an axial direction and terminates in said tip surface lying in a plane substantially perpendicular to said axis.

14. The wrap element and tip seal of claim 12 wherein said groove includes radially inner and outer lateral walls, and a bottom wall.

15. The wrap element and tip seal of claim 12 wherein the height of each strip of material is substantially greater than its width.

16. The wrap element and tip seal of claim 12 wherein each strip defines oppositely facing, substantially parallel lateral surfaces; and an axial tip surface.

17. The wrap element and tip seal of claim 16 wherein the axial tip surface of each strip is slightly rounded.

18. The wrap element and tip seal of claim 16 wherein the adjacent lateral surfaces of adjacent strips are in substantially parallel, contiguous relationship.

19. The wrap element and tip seal of claim 12 wherein said strips are biased in such a manner as to be urged toward a radially outer lateral wall of said groove.

20. The wrap element and tip seal of claim 12 wherein said strips are affixed to one another at least at their radially inner end portions.

21. The wrap element and tip seal of claim 20 wherein said strips are affixed to one another at their radially inner and outer end portions.

22. The wrap element and tip seal of claim 12 wherein said strips are affixed to one another at a plurality of spaced-apart locations along their longitudinal axes.

23. The wrap element and tip seal of claims 20, 21, or 22 wherein said strips of material are metallic, and wherein they are affixed to one another as aforesaid by spot welding.

24. the wrap element and tip seal of claim 22 wherein said plurality of strips of material comprise from three to nine strips.

25. The wrap element and tip seal of claim 22 wherein said strips of material the constructed of steel and have a width from about 0.007 inches to about 0.075 inches.

26. The wrap element and tip seal of claim 22 further comprising a secondary strip of material disposed at least partially within said groove and arranged between one of said strips of material and a lateral wall of said groove, said secondary strip extending along a longitudinal axis about the spiroidal configuration of said groove.

27. The wrap element and tip seal of claim 26 wherein said secondary strip is constructed of a resilient material so as to effect a seal with said lateral wall.

28. The wrap element and tip seal of claims 26 or 17 wherein said secondary strip is disposed between a radially outer lateral wall of said groove and said one of said strips of material.

29. The wrap element and tip seal of claim 12 further comprising a carrier for said strips of material comprising an elongated member disposed within said groove and having a generally U-shaped cross section, the bight portion thereof lying along a bottom wall of said groove and the arm portions extending in an axial direction therefrom toward said tip surface; said plurality of strips being at least partially disposed within the interior of said carrier.

30. The wrap element and tip seal of claim 29 wherein said carrier is constructed of a resilient material so as to effect a seal with a lateral wall of said groove.

31. The wrap element and tip seal as in any one of claims 12-22, 23-27, or 30 further comprising back-up means for imposing a force upon said plurality of strips in an axial direction away from said wrap element while permitting movement thereof in an axial direction.

32. The wrap element and tip seal of claim 31 wherein said back-up means comprise a plurality of springs disposed within said groove between a bottom wall thereof and said plurality of strips, said springs being located at a plurality of longitudinally-spaced points along said groove.

33. The wrap element and tip seal of claim 32 wherein said bottom wall of said groove comprises a plurality of axial bores for receiving said springs.

34. The wrap element and tip seal of claim 32 wherein said springs comprise helical coil springs formed from wire having a substantially circular cross section.

35. The wrap element and tip seal of claim 32 wherein said springs comprise helical springs of the volute type formed from substantially flat spring stock.

36. The wrap element and tip seal of claim 32 further comprising a cap member disposed between each of said springs and said plurality of strips.

37. The wrap element and tip seal of claim 31 wherein said back-up means comprise a length of resilient cord stock disposed within said groove between a bottom wall thereof and said plurality of strips.

38. The wrap element and tip seal of claim 31 wherein said back-up means comprise a generally flat elongated spring member disposed within said groove between a bottom wall thereof and said plurality of strips of material, said spring member extending along a longitudinal axis about the spiroidal configuration of said groove and having a position therein such that one of a radially inner and outer edge portion engages a bottom wall of said groove and the other of said edge portions is axially spaced therefrom, whereby an axial force is developed by said spring member as said other edge portion is disposed toward said bottom wall.

39. The wrap element and tip seal of claim 38 wherein said one edge portion comprises the radially outer edge portion and said other edge portion comprises the radially inner edge portion.

* * * * *

UNITED STATES PATENT AND TRADEMARK OFFICE

CERTIFICATE OF CORRECTION

PATENT NO. : 4,415,317

DATED : November 15, 1983

INVENTOR(S) : Arthur L. Butterworth

It is certified that error appears in the above-identified patent and that said Letters Patent are hereby corrected as shown below:

Claim 24, column 10, line 44 "claim 22" should read --claim 12--.

Claim 25, column 10, line 47 "claim 22" should read --claim 12--.

Claim 26, column 10, line 50 "claim 22" should read --claim 12--.

Claim 28, column 10, line 60 "claims 26 or 17" should read --claims 26 or 27--.

Claim 31, column 11, line 9, "claims 12-22, 23-27, or 30" should read --claims 12-22, 24-27, 29 or 30--.

Signed and Sealed this

*Twenty-fourth* Day of *January 1984*

[SEAL]

*Attest:*

GERALD J. MOSSINGHOFF

*Attesting Officer*

*Commissioner of Patents and Trademarks*